US006422428B1

(12) United States Patent
Allen et al.

(10) Patent No.: US 6,422,428 B1
(45) **Date of Patent: *Jul. 23, 2002**

(54) SEGMENTED APPLICATOR FOR HOT MELT ADHESIVES OR OTHER THERMOPLASTIC MATERIALS

(75) Inventors: Martin A. Allen, Dawsonville; Joel E. Saine, Dahlonega, both of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/702,520

(22) Filed: Oct. 31, 2000

Related U.S. Application Data

(63) Continuation-in-part of application No. 09/141,959, filed on Aug. 28, 1998, which is a continuation-in-part of application No. 09/063,651, filed on Apr. 20, 1998, now abandoned.

(51) Int. Cl.[7] ..... B65D 88/54

(52) U.S. Cl. ..... 222/318; 222/255; 222/330; 222/504; 222/559

(58) Field of Search ..... 222/318, 504, 222/559, 565, 330, 255; 239/128, 133, 134, 135, 267, 268, 550, 551; 425/7, 72.2; 137/884, 338

(56) References Cited

U.S. PATENT DOCUMENTS

| | | | | | |
|---|---|---|---|---|---|
| 3,840,158 | A | * | 10/1974 | Baker et al. | 222/487 |
| 3,849,241 | A | | 11/1974 | Butin et al. | 161/169 |
| 4,073,850 | A | | 2/1978 | Brackmann et al. | 264/93 |
| 4,079,864 | A | * | 3/1978 | Cox | 222/255 |
| 4,478,621 | A | | 10/1984 | Battigelli et al. | 65/4.4 |
| 4,488,665 | A | | 12/1984 | Cocks et al. | 222/146.5 |
| 4,526,733 | A | | 7/1985 | Lau | 264/12 |
| 4,687,137 | A | | 8/1987 | Boger et al. | 239/124 |
| 4,708,619 | A | | 11/1987 | Balk | 425/141 |
| 4,785,996 | A | | 11/1988 | Ziecker et al. | 239/298 |
| 4,815,660 | A | | 3/1989 | Boger | 239/8 |
| 4,891,249 | A | | 1/1990 | McIntyre | 427/421 |
| 4,983,109 | A | | 1/1991 | Miller et al. | 425/7 |
| 5,000,112 | A | * | 3/1991 | Rothen et al. | 118/411 |
| 5,145,689 | A | | 9/1992 | Allen et al. | 425/72.2 |
| 5,172,833 | A | | 12/1992 | Faulkner, III | 222/146.5 |
| 5,236,641 | A | | 8/1993 | Allen et al. | 264/40.1 |
| 5,382,312 | A | | 1/1995 | Raterman | 156/500 |
| 5,418,009 | A | * | 5/1995 | Raterman et al. | 427/207.1 |
| 5,421,941 | A | * | 6/1995 | Allen et al. | 156/244.11 |

(List continued on next page.)

FOREIGN PATENT DOCUMENTS

| | | |
|---|---|---|
| DE | 68534594.6 | 12/1985 |
| EP | 0820817 | 1/1988 |
| WO | PCT/US93/06434 | 7/1993 |

*Primary Examiner*—William C. Doerrler
*Assistant Examiner*—Frederick C Nicolas
(74) *Attorney, Agent, or Firm*—Wood, Herron & Evans, L.L.P.

(57) ABSTRACT

A modular applicator for dispensing liquid including a plurality of manifold segments, a plurality of removable pumps, and a drive motor coupled to each pump. The manifold segments are coupled in side-by-side relation and each includes a liquid supply passage and a liquid discharge passage. Each pump includes an inlet communicating with the liquid supply passage, an outlet communicating with the liquid discharge passage and a pumping mechanism for pumping the liquid from the inlet to the outlet. The drive motor is coupled to each pump to simultaneously operate each pumping mechanism and dispense the liquid from a plurality of dispensing modules coupled with each manifold segment. The dispensing modules are recirculating modules which direct the liquid back into the corresponding manifold segment when they are in closed positions.

23 Claims, 5 Drawing Sheets

U.S. PATENT DOCUMENTS 5,445,674 A 8/1995 DeMars ..... 118/669
5,540,804 A * 7/1996 Raterman ..... 156/500
5,556,471 A * 9/1996 Boccagno et al. ..... 118/300
5,605,720 A 2/1997 Allen et al. ..... 427/288
5,618,566 A 4/1997 Allen et al. ..... 425/7
5,620,139 A * 4/1997 Ziecker ..... 239/124
5,636,790 A * 6/1997 Brusko et al. ..... 239/124
5,679,379 A 10/1997 Fabbricante et al. ..... 425/7
5,683,752 A 11/1997 Popp et al. ..... 427/421
5,728,219 A 3/1998 Allen et al. ..... 118/315
5,862,986 A * 1/1999 Bolyard, Jr. et al. ..... 239/135
5,875,922 A 3/1999 Chastine et al. ..... 222/1
5,950,875 A 9/1999 Lee et al. ..... 222/145.5
6,089,413 A * 7/2000 Riney et al. ..... 222/318
6,210,141 B1 * 4/2001 Allen ..... 425/7
6,220,843 B1 * 4/2001 Allen ..... 425/7
6,296,463 B1 * 10/2001 Allen ..... 425/7

* cited by examiner

SEGMENTED APPLICATOR FOR HOT MELT ADHESIVES OR OTHER THERMOPLASTIC MATERIALS

This is a continuation-in-part application of U.S. application Ser. No. 09/141,959, filed Aug. 28, 1998 (pending) which is a continuation-in-part of U.S. application Ser. No. 09/063,651, filed Apr. 20, 1998 (abandoned). The disclosures of these two related patent applications are hereby fully incorporated by reference herein.

FIELD OF THE INVENTION

The present invention generally relates to applicators or fiberization dies for applying thermoplastic materials to a substrate or for producing nonwoven materials.

BACKGROUND OF THE INVENTION

Thermoplastic materials, such as hot melt adhesive, are dispensed and used in a variety of situations including the manufacture of diapers, sanitary napkins, surgical drapes as well as many others. This technology has evolved from the application of linear beads or fibers of material and other spray patterns, to air-assisted applications, such as spiral and meltblown depositions of fibrous material.

Often, the applicators will include one or more dispensing modules for applying the intended deposition pattern. Many of these modules include valve components to operate in an on/off fashion. One example of a dispensing module is disclosed in U.S. Pat. No. 6,089,413, assigned to the assignee of the present invention, and the disclosure of which is hereby fully incorporated by reference herein. This module includes valve structure which changes the module between ON and OFF conditions relative to the dispensed material. In the OFF condition, the module enters a recirculating mode. In the recirculating mode, the module redirects the pressurized material from the liquid material inlet of the module to a recirculation outlet which, for example, leads back into a supply manifold and prevents the material from stagnating. Many other modules or valves have also been used to provide selective metering and/or on/off control of material deposition.

Various dies or applicators have also been developed to provide the user with some flexibility in dispensing material from a series of modules. For short lengths, only a few dispensing modules are mounted to an integral manifold block. Longer applicators may be assembled by adding additional modules to the manifold. Additional flexibility may be provided by using different die tips or nozzles on the modules to permit a variety of deposition patterns across the applicator as well. The most common types of air-assisted dies or nozzles include meltblowing dies, spiral nozzles, and spray nozzles. Pressurized air used to either draw down or attenuate the fiber diameter in a meltblowing application, or to produce a particular deposition pattern, is referred to as process air. When using hot melt adhesives, or other heated thermoplastic materials, the process air is typically also heated so that the process air does not substantially cool the thermoplastic material prior to deposition of the material on the substrate or carrier. Therefore, the manifold or manifolds used in the past to direct both thermoplastic material and process air to the module include heating devices for bringing both the thermoplastic material and process air to an appropriate application temperature.

In the above-incorporated patent applications, various embodiments of modular applicators are disclosed which allow a user to more easily configure the applicator according to their needs. Generally, these applicators include a plurality of manifold segments disposed in side-by-side relation, with each manifold segment including a dispensing module or valve and a positive displacement pump. Material, such as hot melt adhesive, flows through the side-by-side manifold segments to each pump. The pumps individually direct the material to each corresponding dispensing module. Heated process air is also directed through each manifold segment to the die tip or nozzle of the module and impacts the dispensed material to achieve a desired effect on the deposition pattern. A separate recirculating module is provided so that the material discharged from the pump flows to the recirculation module if the fiberization die module is shut off or closed. The recirculated flow ensures that flow through the pump is uninterrupted. These related applications disclose applicators having a single integral drive shaft extending through side-by-side positive displacement gear pumps or, alternatively, a segmented drive shaft which allows the manifold segments to be removed or added without the need for disassembling the entire manifold. In each case, the number of manifold segments and modules define the effective dispensing length of the applicator.

Despite the various progress made in the technology, there is still a need to increase the speed and efficiency at which an applicator may be configured and maintained or repaired. There is also a continuing desire to reduce the cost and complexity associated with these applicators.

SUMMARY OF THE INVENTION

The present invention generally provides a modular applicator for dispensing liquid including a plurality of manifold segments coupled in side-by-side relation. Each manifold segment includes a liquid supply passage and a liquid discharge passage. A plurality of pumps are respectively mounted in a removable manner to the plurality of manifold segments. Each of the pumps includes an inlet communicating with the liquid supply passage of the corresponding manifold segment, an outlet communicating with the liquid discharge passage of the corresponding manifold segment and a pumping mechanism for pumping the liquid from the inlet to the outlet. A drive motor is coupled to each of the pumps for operating each of the associated pumping mechanisms.

More specifically, the plurality of pumps are preferably gear pumps with one of the gears being a drive gear. A shaft is coupled between the drive motor and each of the drive gears to simultaneously operate each of the pumps. The system further includes a plurality of on/off dispensing modules respectively coupled with the manifold segments. These dispensing modules may be pneumatically operated valves and, for operational purposes, the manifold segments include air distribution passages for delivering pressurized control air to each of the pneumatically operated valves. An air control valve may be mounted to one or more of the manifold segments to selectively supply the pressurized control air to an associated one or more of the pneumatically operated valves. The manifold segments further include liquid distribution passages for delivering the liquid from one of the manifold segments to another of the manifold segments through opposed side surfaces thereof. Likewise, process air distribution passages also communicate between adjacent manifold segments for supplying heated process air to each of the modules. A pair of heating rods extend through each of the manifold segments for heating liquid and process air sections thereof. The liquid and process air sections of each manifold segment are thermally separated by one or more insulators, such as slots and/or bores.

The dispensing modules are preferably recirculating modules and appropriate passages are provided in each associated manifold segment to ensure that liquid is recirculated back into the manifold segment if the module is in an OFF position. The preferred liquid dispensing system also has the advantage that the pumps may be removed from the manifold segment without decoupling the manifold segments from one another. In this regard, the common drive shaft may be disengaged from one or more pumps by pulling the drive shaft out of one end of the manifold and, once disengaged, the appropriate pump or pumps may be removed and either repaired or replaced as necessary.

Various additional advantages and features of the invention will become more readily apparent to those of ordinary skill in the art upon review of the following detailed description taken in conjunction with the accompanying drawings.

DETAILED DESCRIPTION OF THE PREFERRED EMBODIMENTS

Figure 1:
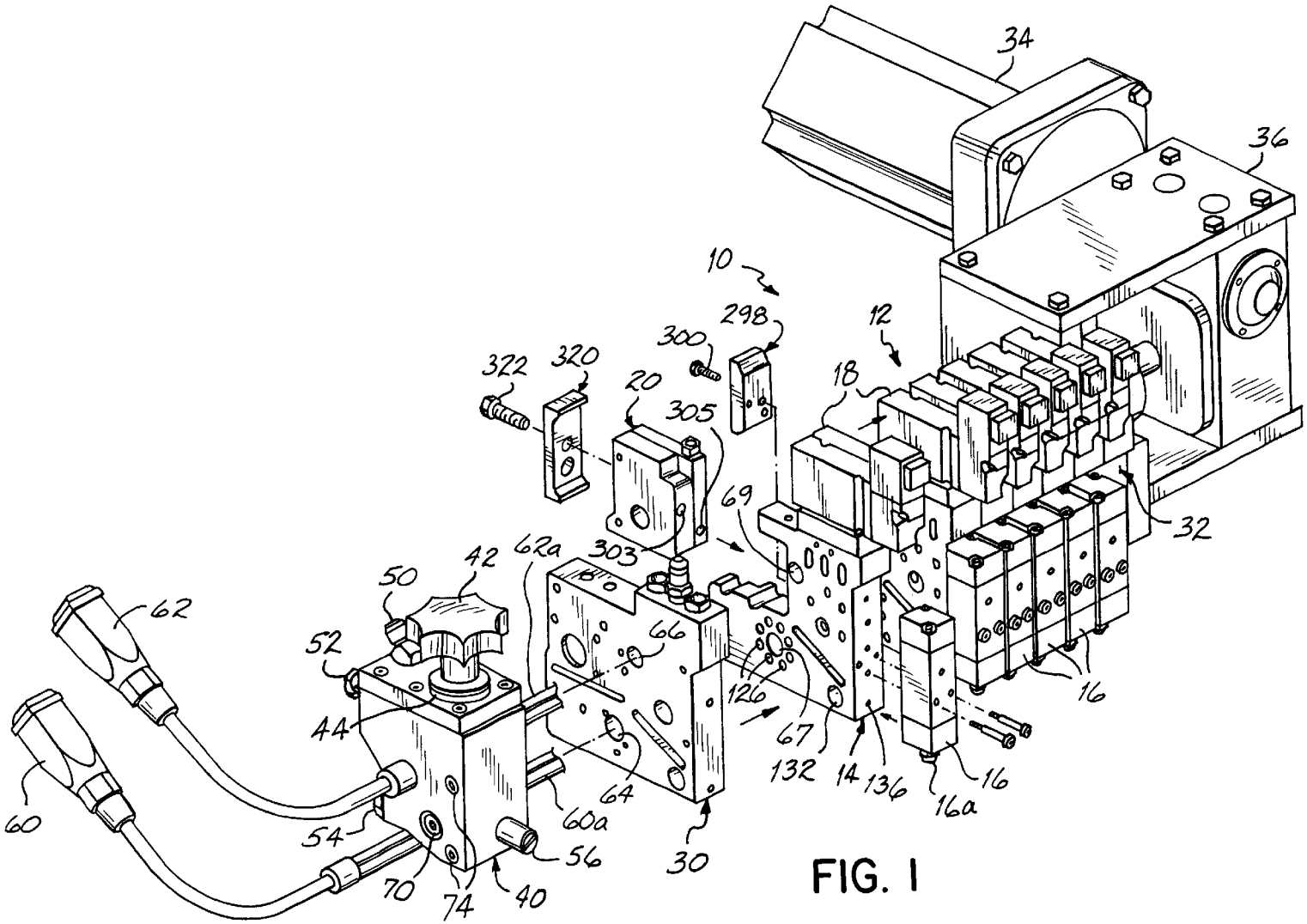
FIG. 1 is a partially exploded perspective view illustrating the preferred dispensing applicator of the present invention.

FIG. 1 illustrates a preferred applicator constructed in accordance with the inventive concepts. Applicator 10 includes a dispensing assembly 12 comprised of individual side-by-side manifold segments 14, dispensing modules 16, air control valves 18 and gear pumps 20. In general, a pressurized liquid is introduced into manifold segments 14 and is metered by gear pumps 20 individually associated with each manifold segment 14 to each corresponding dispensing module 16. Air control valves 18 selectively supply pressurized control air through the attached manifold segment 14 to the corresponding module 16 to operate module 16 between open and closed (ON and OFF) positions. Dispensing module 16 is preferably a recirculating module, such as the module disclosed in U.S. Pat. No. 6,089,413 incorporated above.

In the illustrated embodiment of applicator 10, each manifold segment 14 includes an identical dispensing module 16, air control valve 18, which may be a conventional spool operated solenoid valve, and gear pump 20. From the description to follow, it will be appreciated that the plurality of dispensing modules may be controlled by less than a corresponding number of air control valves 18. Also, one or more gear pumps 20 may be removed and replaced with a substitution block (not shown) which diverts liquid material back into the corresponding manifold segment 14 and does not direct the liquid material into a corresponding dispensing module 16. Thus, dispensing assembly 12 may be configured in many different manners depending on the application needs and desires of the user. Except as noted herein, each assembly comprised of a manifold segment 14, a dispensing module 16, an air control valve 18 and a gear pump 20 is preferably identical.

As further shown in FIG. 1, dispensing assembly 12 includes a pair of end plates 30, 32 sandwiching the dispensing portion of assembly 12 therebetween. A DC servo motor 34 and conventional right angle gear box 36 are provided to simultaneously drive each gear pump 20 coupled with manifold segments 14. A filter block 40 is secured to end plate 30 and contains a removable filter element (not shown) accessible by turning a handle 42 coupled with a threaded cap 44. The filter element within block 40 filters liquid material introduced through an input 50 before directing that material through end plate 30 and into the adjacent manifold segment 14 for distribution to each gear pump 20 and ultimately each module 16. Filter block 40 includes a pre-filter transducer port 52 and a post-filter transducer port 54. These ports 52, 54 allow pressure transducers to be coupled upstream and downstream of the filter element to allow measurement of the pressure differential and thereby allow detection of a clogged filter condition which necessitates cleaning or replacement. A pressure relief valve 56 is provided to relieve liquid pressure within dispensing assembly 12 during, for example, maintenance and repair. A pair of cordsets 60, 62 and corresponding heater rods 60*a*, 62*a* are provided to respectively heat the process air section and liquid section of each manifold segment 14. Rods 60*a*, 62*a* are respectively inserted through holes 64 and 66 in end plate 30 and holes 67, 69 which align in each manifold segment 14. A plug 70 is threaded into one side of the liquid supply passage in filter block 40 with the other side aligning with the liquid supply passage of the adjacent manifold segment 14 as will be discussed below. Fasteners 74 couple filter block 40 to end plate 30.

Figure 2:
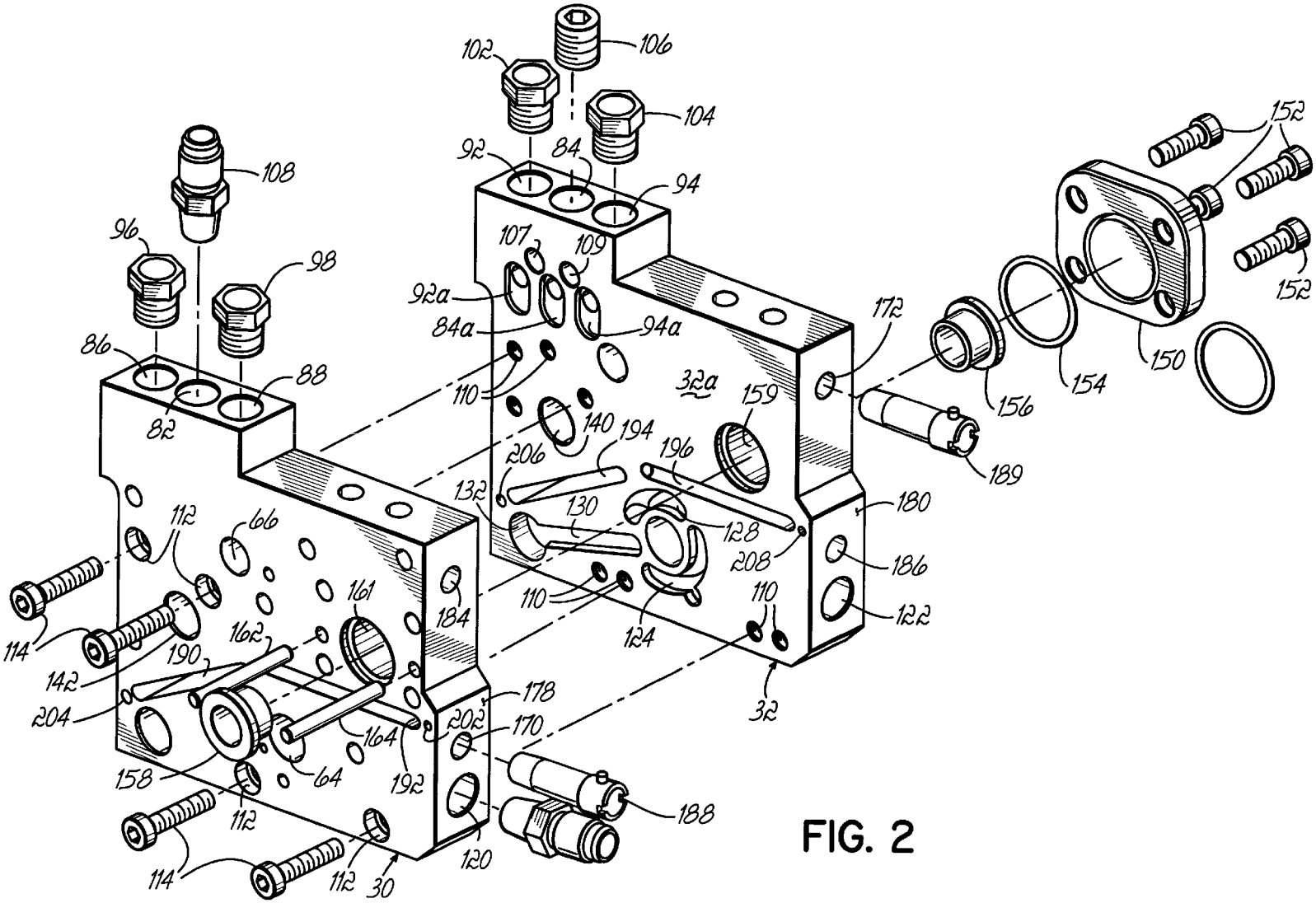
FIG. 2 is an exploded perspective view showing the end plates of the manifold assembly.

Referring to FIG. 2, end plates 30, 32 are shown in greater detail with certain components illustrated in exploded view for clarity. Each end plate 30, 32 includes a control air input port 82, 84 and a pair of control air exhaust ports 86, 88 and 92, 94 which receive threaded exhaust filters 96, 98 and 102, 104. Port 84 includes a plug 106, although it will be appreciated that this supply port 84 may instead include an input fitting 108 as shown with the opposite end plate 30, depending on the needs of the user. A supply port 84*a* and exhaust ports 92*a*, 94*a* communicate with the control air input 84 and exhaust ports 92, 94 in the top of each end plate as shown in end plate 32. In addition, two additional ports 107, 109 are provided on the inside facing surface of each end plate and are used to direct control air to the adjacent manifold segment as will be described below. Each end plate 30, 32 also includes a plurality of threaded fastener holes 110 and counterbored fastener receiving holes 112. Fasteners 114 are used to secure the respective end plate 30, 32 to the adjacent manifold segment 14 (FIG. 1).

Process air is supplied into either of the end plates 30, 32 through a bore 120 or 122. The other bore is plugged. The bores 120,122 lead to a process air slot 124 as shown on inner face 32*a* of plate 32. Although not shown, plate 30 has the same slot on its inner face. Process air therefore supplied to slot 124 and this slot 124 communicates with a series of radially spaced bores 126 in each manifold segment 14 surrounding the process air heating rod 60*a* (FIG. 1). Each slot 126 redirects air in a serpentine fashion through the bores 126 such that it is uniformly heated as it traverses back-and-forth along the length of the connected manifold segments 14 and heater rod 60*a*. Another slot 128 also directs the process air in this serpentine fashion. The final bore 126 in the serpentine air flow path communicates with a slot 130 which leads to an air supply passage 132. The air supply passage 132 extends through each of the connected manifold segments 14 and a perpendicular bore 136 in each manifold segment 14 communicates with the corresponding module 16 to provide the process air to the nozzle region 16*a*.

A liquid material input passage 140 communicates with the liquid supply passage of filter block 40 and with the respective inputs of the manifold segments in a serial fashion as will be discussed below. The input port 142 in the opposite end plate 30 is plugged. A cover plate 150 is attached to each end plate 30, 32 with each plate 150 secured by sets of fasteners 152 and sealed by an O-ring 154. Only the cover plate 150 associated with end plate 32 is shown in FIG. 2 for clarity although it will be appreciated that an identical cover plate assembly is used on end plate 30. A shoulder bearing 156 is provided in a hole 159 for the drive shaft (not shown in FIG. 2) coupled with each gear pump 20. When cover plate 150 is removed, the drive shaft may be pulled out of one or more of the gear pumps 20 to allow removal of that gear pump 20 from the corresponding manifold segment 14. A similar bearing 158 is provided in a hole for the drive shaft and a pair of roll pins 162, 164 are provided in the opposite end plate 30.

A process air sensor port 170 and a liquid sensor port 172 are provided in bores 174, 176 extending through edge portions 178, 180 of each end plate 30, 32 with the remaining bores 184, 186 of the end plates 30, 32 receiving plugs (not shown), as necessary. Ports 170, 172 receive temperature sensors 188, 189 for respectively measuring the temperatures of the process air section, i.e., lower section of each end plate 30, 32 and the liquid section, i.e., upper section of each end plate 30, 32. The upper and lower sections are divided by insulators which, in this preferred embodiment, comprise pairs of slots 190, 192 and 194, 196 and pairs of holes 202, 204 and 206, 208. These air spaces therefore provide thermal insulation between the upper section and lower section and allow these respective sections to be maintained at different operating temperatures. It will be appreciated that other types of insulators and insulating materials may be used as well.

Figure 3:
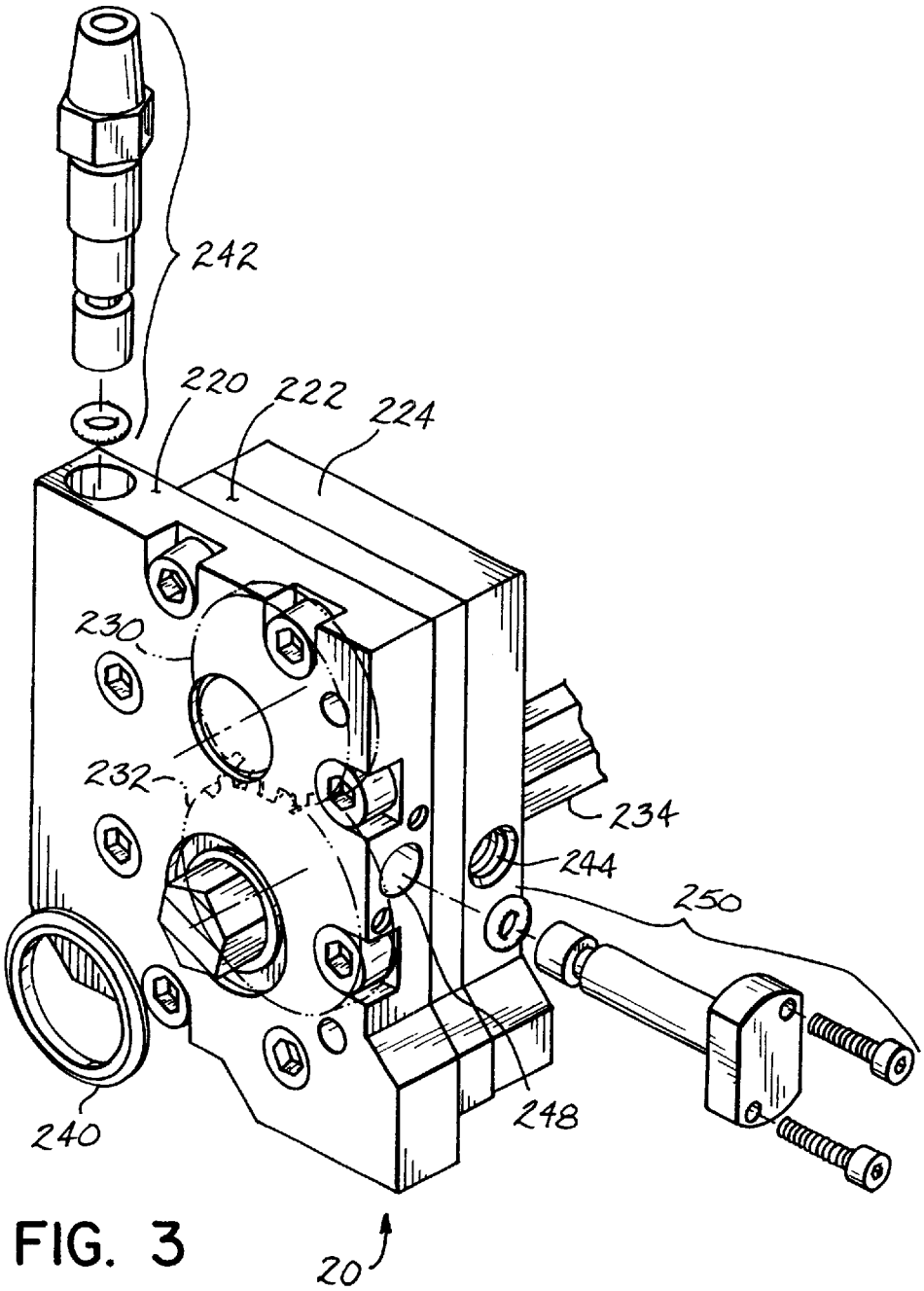
FIG. 3 is a partially exploded perspective view showing one of the gear pumps.

As further shown in FIG. 3, each gear pump 20 comprises a conventional sandwiched construction of three plates 220, 222, 224 containing a pair of gears 230, 232. One gear is an idler gear 230, while the other gear is a driven gear 232 which receives a drive shaft 234 having a hexagonal cross section. It will be appreciated that drive shaft 234 extends through each gear pump 20 and is received in a complimentary hexagonally-shaped bore of each drive gear 232. A static seal 240 contains any liquid which would otherwise tend to seep out of gear pump 20. A rupture disc assembly 242 is provided for providing pressure relief in the event of a significant over-pressure condition. On the back side of each gear pump 20, one port 244 is threaded to receive a temperature sensor (not shown). This is especially useful during start-up to ensure that each gear pump 20 is heated to the application temperature before operation. This threaded port 244 may also receive an extractor tool (not shown) for removing the gear pump 20 from the associated manifold segment 14 during repair or replacement without having to dissemble or decouple the manifold segments 14 from one another. The second bore 248 receives a plug assembly 250, which may be removed to then allow insertion of a pressure transducer (not shown) for reading output liquid pressure.

Figure 4:
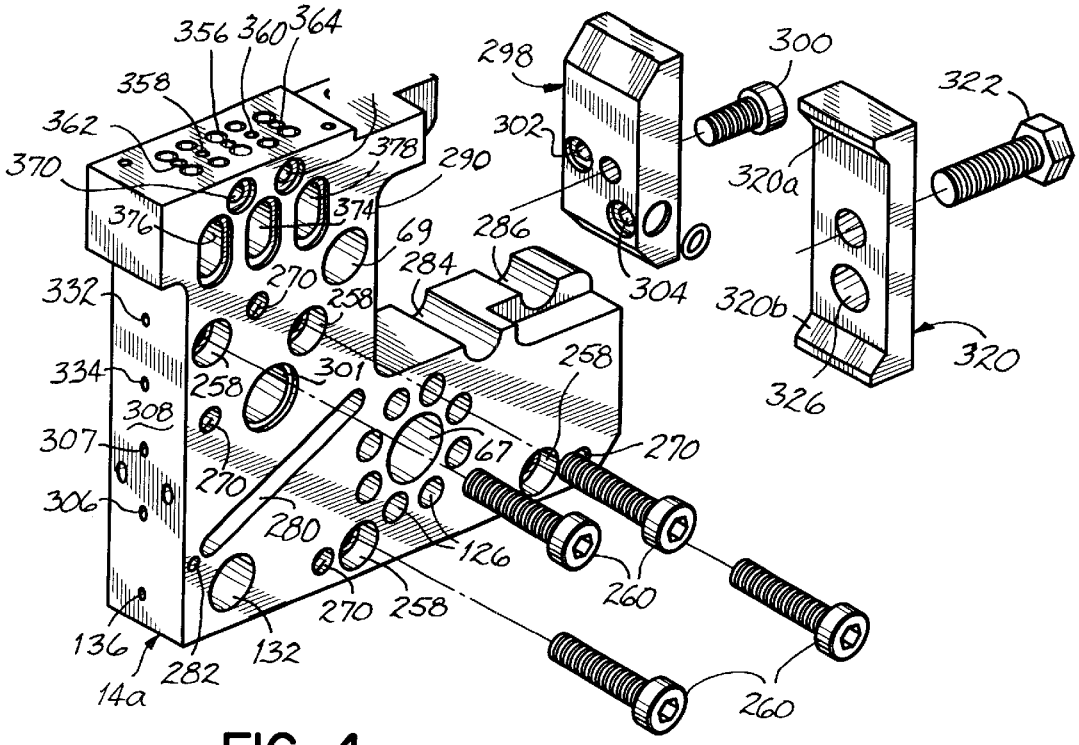
FIG. 4 is an exploded perspective view illustrating a first manifold segment.
Figure 5:
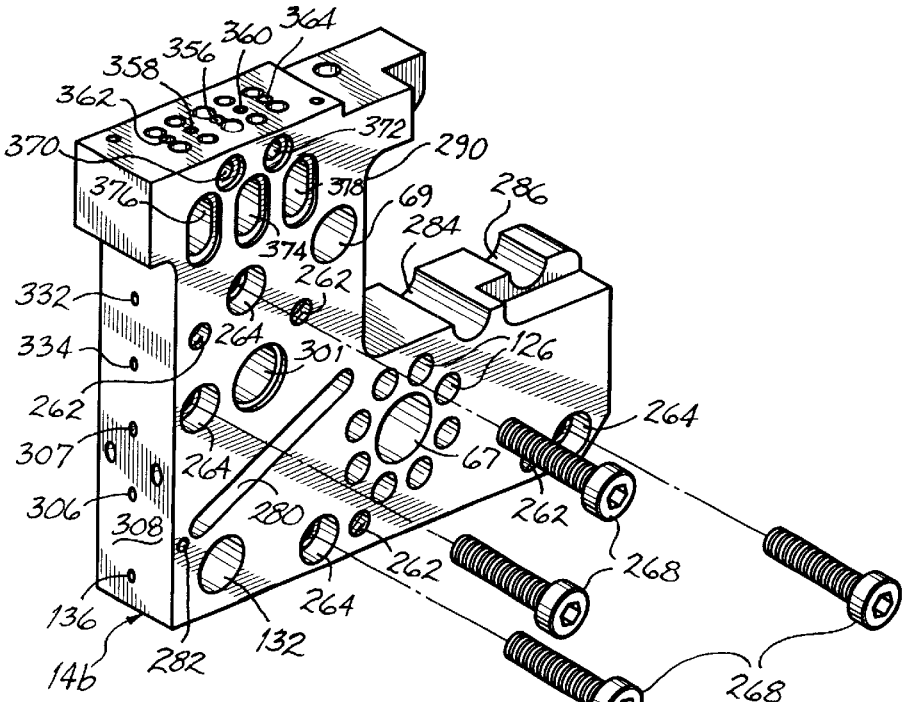
FIG. 5 is an exploded perspective view illustrating a second manifold segment.

Referring now to FIGS. 4 and 5, each manifold segment 14*a*, 14*b* is identical, except for the fastener configurations used to fasten manifold segments 14*a*, 14*b* together. In this regard, manifold segment 14*a* includes four counterbored fastener holes 258 for receiving four fasteners 260, while the corresponding holes 262 in an adjacent manifold segment 14*b* are threaded to receive the threaded portions of fasteners 260. Likewise, manifold segment 14*b* includes four counterbored fastener holes 264 for receiving four fasteners 268 and the threaded portions of these fasteners 268 are received in threaded holes 270 in an adjacent manifold segment 14*a* as shown in FIG. 4. As previously described, a plurality of radially spaced bores 126 direct process air in a serpentine, back-and-forth manner along the length of dispenser assembly (FIG. 1) so that the process air is heated as it traverses back-and-forth alongside the heater rod 60*a* contained in hole 67. A slot 280 and a hole 282, as well as a pair of recesses 284, 286 are provided for thermally isolating the lower process air section of each manifold segment 14, 14*b* from the upper liquid section of each manifold segment 14*a*, 14*b* in a manner similar to that discussed in connection with the end plates 30, 32. The recess 290 in the back side of each manifold segment 14*a*, 14*b* receives a gear pump 20. A diverter plate 298 (only one shown) is secured to each manifold segment 14*a*, 14*b* with a fastener 300 and may be configured to direct the liquid in various manners. In the preferred embodiment shown, liquid is directed from liquid material input passage 140 into aligned supply bores 301 in manifold segments 14*a*, 14*b*. The liquid is then directed into an internal passage (not shown) and into a bore 302 in each diverter plate 298. Bore 302 communicates with a supply passage 303 in the associated gear pump 20 (FIG. 1) connected gear pump 20 (FIG. 1) and exits from the gear pump 20 through a discharge passage 305 of gear pump 20 and into a bore 304 communicating with a discharge passage 306 at a front edge portion 308 of the manifold segment 14*a*. Passage 306 supplies the pressurized liquid to the associated dispensing module 16. Another passage 307 is a recirculation passage which receives liquid from the associated dispensing module 16 when the module 16 is OFF. Passage 307 communicates with supply passage 301. Each gear pump 20 is held on with a clamp 320 and fastener 322. Clamp 320 includes upper and lower angled surfaces 320*a*, 320*b* acting as cam surfaces to engage complimentary surfaces at lower edges of the gear pump 20 and the manifold segment 14*a*, respectively. Another bore 326 in the clamp 320 is provided for receiving a bayonet process air sensor (not shown) as described in connection with FIG. 2.

Figure 6:
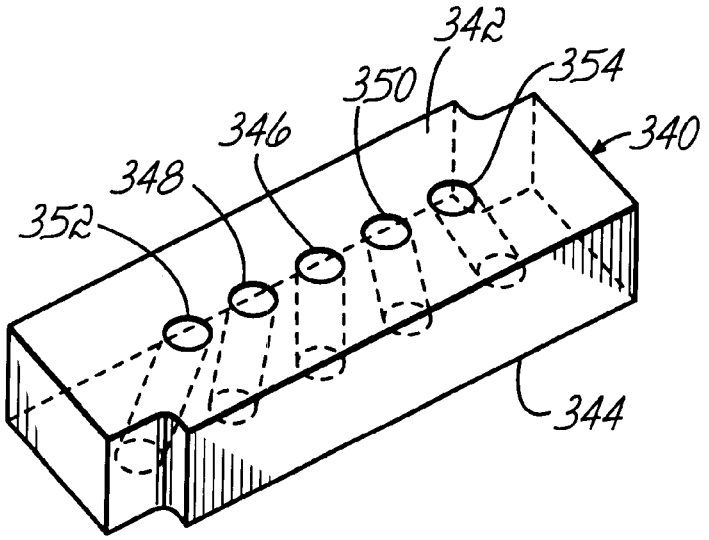
FIG. 6 is a perspective view of a gasket positioned between one of the manifold segments and a corresponding one of the air control valves.

As further shown in FIGS. 4 and 5, two passages 332, 334 are provided on front edge 308 of each manifold segment 14*a*, 14*b*. Passages 332, 334 supply pressurized control air to the associated dispensing module 16 for pneumatically actuating a piston within module 16 between open and closed positions. Referring to FIG. 6A, for the preferred embodiment in which each manifold segment 14 (FIG. 1) is controlled by a separate air control valve 18, a gasket 340 is placed between manifold segment 14 and air control valve 18. Gasket 340 includes a lower surface 342 and an upper surface 344. An air supply hole 346 is centrally located and communicates with air supply port 82. Hole 346 is flanked by air distribution passages 348, 350 which respectively communicate with passages 332, 334 after assembly onto manifold segment 14. Respective air exhaust passages 352, 354 respectively communicate with exhaust ports 92*a*, 94*a* after assembly. More specifically referring to FIGS. 4 and 5, holes 346, 348, 350, 352, 354 respectively align with holes or passages 356, 358, 360, 362, 364 on top of the associated manifold segment 14*a* or 14*b*. Manifold segments 14*a*, 14*b* further include an air supply port 374 which communicates with passage 356 and exhaust ports 376, 380 which respectively communicate with passages 362, 364. Passages 370, 372 are also provided for an optional manifold segment to manifold segment distribution of control air if only one air control valve 18 is to be used to operate a plurality of dispensing modules 16.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein we claim:

What is claimed is:

1. A modular applicator for dispensing liquid comprising:

a plurality of manifold segments coupled in side-by-side relation, each manifold segment having a liquid supply passage and a liquid discharge passage, a plurality of pumps respectively mounted in a removable manner to said plurality of manifold segments, each of said pumps including an inlet communicating with said liquid supply passage, an outlet communicating with said liquid discharge passage and a pumping mechanism for pumping the liquid from said inlet to said outlet, and a drive motor coupled to each of said pumps for operating each of said pumping mechanisms.

2. The liquid dispensing applicator of claim 1, wherein said pumping mechanism further comprises a plurality of gears mounted within each of said pumps.

3. The liquid dispensing applicator of claim 2, further comprising a shaft coupled to said drive motor and to at least one of said gears of each pumping mechanism.

4. The liquid dispensing applicator of claim 1, further comprising a plurality of dispensing modules respectively coupled with said plurality of manifold segments, each dispensing module operating to selectively dispense the liquid.

5. The liquid dispensing applicator of claim 1, wherein said dispensing modules further comprise pneumatically operated valves and said manifold segments further include air distribution passages for delivering pressurized control air to operate each of said valves.

6. The liquid dispensing applicator of claim 5, further comprising at least one air control valve, said air control valve mounted to one of said plurality of manifold segments and adapted to be connected with a supply of the pressurized control air operative to selectively supply the pressurized control air to at least one of said pneumatically operated valves.

7. The liquid dispensing applicator of claim 1, wherein said pumps are removable from said manifold segments without decoupling said manifold segments from one another.

8. The liquid dispensing applicator of claim 7, wherein said manifold segments further include opposed side surfaces and liquid distribution passages for delivering the liquid from one of said manifold segments to another of said manifold segments through said opposed side surfaces.

9. The liquid dispensing applicator of claim 1, wherein said manifold segments further include opposed side surfaces and liquid distribution passages for delivering the liquid from one of said manifold segments to another of said manifold segments through said opposed side surfaces.

10. The liquid dispensing applicator of claim 9, further comprising a heater extending through said plurality of manifold segments.

11. The liquid dispensing applicator of claim 9, wherein said manifold segments further include opposed side surfaces and process air distribution passages for delivering process air from one of said manifold segments to another of said manifold segments through said opposed side surfaces.

12. The liquid dispensing applicator of claim 11, further comprising two heaters extending through said plurality of manifold segments, one of said heaters primarily operating to heat the liquid and the other of said heaters primarily operating to heat the process air.

13. The liquid dispensing applicator of claim 12, further comprising a thermal insulator positioned between said two heaters in each of said manifold segments to form a liquid heating zone and a process air heating zone capable of being held at two different operating temperatures respectively by said heaters.

14. A modular applicator for dispensing liquid comprising:

a plurality of manifold segments having a plurality of edge portions and opposed side surfaces disposed between said edge portions, said manifold segments coupled together in side-by-side relation with said side surfaces of adjacent manifold segments directed toward one another, and each of said manifold segments having a recess communicating with at least one of said edge portions, a liquid supply passage and a liquid discharge passage within each manifold segment, a plurality of pumps each mounted in said recess of one of said manifold segments and being removable from said recess without decoupling said manifold segments from one another, each of said pumps including an inlet communicating with said liquid supply passage, an outlet communicating with said liquid discharge passage and a pumping mechanism for pumping the liquid from said inlet to said outlet, and a drive motor coupled to each of said pumps for operating each of said pumping mechanisms.

15. The liquid dispensing applicator of claim 14, wherein said pumping mechanism further comprises a plurality of gears mounted within each of said pumps.

16. The liquid dispensing applicator of claim 15, further comprising a shaft coupled to said drive motor and to at least one of said gears of each pumping mechanism.

17. The liquid dispensing applicator of claim 14, further comprising a plurality of dispensing modules respectively coupled with said plurality of manifold segments, each dispensing module operating to selectively dispense the liquid from said manifold segments.

18. The liquid dispensing applicator of claim 17, wherein said manifold segments further include liquid distribution passages for delivering the liquid from one of said manifold segments to another of said manifold segments through said opposite faces.

19. The liquid dispensing applicator of claim 18, wherein said manifold segments further include process air distribution passages for delivering process air from one of said manifold segments to another of said manifold segments through said opposite faces.

20. A modular applicator for dispensing liquid comprising:

a plurality of manifold segments having a plurality of edge portions and opposed side surfaces disposed between said edge portions, said manifold segments coupled together in side-by-side relation with said side surfaces of adjacent manifold segments directed toward one another, and each of said manifold segments having a recess communicating with at least one of said edge portions, a liquid supply passage and a liquid discharge passage within each manifold segment, a plurality of positive displacement gear pumps each mounted in said recess of one of said manifold segments and being removable from said recess without decoupling said manifold segments from one another, each of said pumps including an inlet communicating with said liquid supply passage, an outlet communicating with said liquid discharge passage and a plurality of gears for pumping the liquid from said inlet to said outlet, a drive motor having a rotatable drive shaft extending through at least one of said gears of each pump to simultaneously operate each of said pumps, and a plurality of recirculating dispensing modules each having an ON condition and an OFF condition, each of said plurality of dispensing modules respectively coupled with one of said plurality of manifold segments and capable of dispensing the liquid from a corresponding one of said manifold segments when in an ON condition and recirculating the liquid back into said corresponding manifold segment when in an OFF condition.

21. A modular applicator for dispensing liquid comprising:

a plurality of dispensing modules each having a liquid inlet for receiving liquid, a liquid outlet, and a valve positioned between said liquid inlet and said liquid outlet, said valve operative to selectively dispense liquid from said liquid outlet; and a plurality of manifold segments each coupled to a corresponding one of said dispensing modules; each of said manifold segments having opposed side surfaces, a liquid distribution passage extending between said side surfaces, and a liquid supply pathway coupling said liquid distribution passage with said liquid inlet of with said corresponding dispensing modul[0085] said manifold segments attached together in side-by-side relation with said side surfaces of adjacent manifold segments directed toward one another and said liquid distribution passage of one of said manifold segments coupled in fluid communication with said liquid distribution passage of another of said manifold segments.

22. The modular applicator of claim 21 further comprising a plurality of pumps, said pumps respectfully mounted in said manifold segments, each of said pumps operative for pumping the liquid through said corresponding liquid supply pathway to said corresponding dispensing module.

23. The modular applicator of claim 22 wherein each of said pumps is removable from said corresponding liquid supply pathway without decoupling said manifold segments from one another.

* * * * *

UNITED STATES PATENT AND TRADEMARK OFFICE

CERTIFICATE OF CORRECTION

PATENT NO. : 6,422,428 B1
DATED : July 23, 2002
INVENTOR(S) : Martin A. Allen et al.

It is certified that error appears in the above-identified patent and that said Letters Patent is hereby corrected as shown below:

Column 10,
Line 2, after “receiving” insert -- the --.
Line 5, after “dispense” insert -- the --.
Line 12, delete “with said corresponding” and insert -- one of said --.
Line 12, delete “modul[0085]” and insert -- modules, --.

Signed and Sealed this

Thirteenth Day of May, 2003

JAMES E. ROGAN
*Director of the United States Patent and Trademark Office*